US008091745B2

(12) United States Patent
Neukirch et al.

(10) Patent No.: US 8,091,745 B2
(45) Date of Patent: Jan. 10, 2012

(54) DISPOSABLE TAP FOR A PRESSURIZED LIQUID CONTAINER

(75) Inventors: Werner Neukirch, Andernach (DE); Peter Sauer, Mülheim-Kerlich (DE)

(73) Assignee: Impress Group B.V., Deventer (NL)

( * ) Notice: Subject to any disclaimer, the term of this patent is extended or adjusted under 35 U.S.C. 154(b) by 1127 days.

(21) Appl. No.: 11/571,157

(22) PCT Filed: Jun. 24, 2005

(86) PCT No.: PCT/EP2005/006857

§ 371 (c)(1),
(2), (4) Date: Jul. 31, 2007

(87) PCT Pub. No.: WO2006/000437

PCT Pub. Date: Jan. 5, 2006

(65) Prior Publication Data

US 2008/0041892 A1 Feb. 21, 2008

(30) Foreign Application Priority Data

Jun. 25, 2004 (EP) ..... 04014958

(51) Int. Cl.
*B67D 1/04* (2006.01)

(52) U.S. Cl. ..... 222/538; 222/518; 222/553; 222/532; 251/351

(58) Field of Classification Search ..... 222/538, 222/567, 399, 523, 553, 532, 559, 518, 396, 222/394; 251/353–354, 351; 137/540
See application file for complete search history.

(56) References Cited

U.S. PATENT DOCUMENTS

| | | | | | |
|---|---|---|---|---|---|
| 1,080,273 | A | * | 12/1913 | Fountain | 251/353 |
| 1,744,216 | A | * | 1/1930 | Draper | 222/525 |
| 1,912,304 | A | * | 5/1933 | Phillips | 222/513 |
| 2,112,317 | A | * | 3/1938 | Valentine | 222/539 |
| 2,751,119 | A | * | 6/1956 | Manning, Sr. | 222/81 |
| 2,992,763 | A | * | 7/1961 | Huertas | 222/484 |
| 3,039,656 | A | | 6/1962 | Wentz | |
| 3,243,085 | A | * | 3/1966 | Wilson | 222/396 |
| 4,742,851 | A | * | 5/1988 | Lundblade | 137/614.12 |
| 4,923,095 | A | | 5/1990 | Dorfman et al. | |
| 4,997,108 | A | * | 3/1991 | Hata | 222/105 |
| 5,096,092 | A | | 3/1992 | Devine | |
| 5,110,012 | A | * | 5/1992 | Scholle et al. | 222/83.5 |
| 5,333,763 | A | | 8/1994 | Lane et al. | |
| 5,769,282 | A | | 6/1998 | Lane et al. | |

(Continued)

FOREIGN PATENT DOCUMENTS

DE 298 22 430 U1 5/1999

(Continued)

*Primary Examiner* — Kevin P Shaver
*Assistant Examiner* — Robert Nichols, II
(74) *Attorney, Agent, or Firm* — Gudrun E. Huckett

(57) ABSTRACT

The invention relates to a disposable tap (1) for tapping liquid from a pressurized liquid container. Compared to prior art taps, the inventive disposable tap is modified so that it can be preferably placed in the upper area of the lateral wall of the liquid container. To this end, the tap comprises a lateral inlet opening (21) which is oriented downward when the tap is mounted and which is provided for coupling, in a sealing manner, to an ascending tube (34), and comprises elements (6, 7, 8), which control the entrance of liquid into the tap and to the outlet (of the tap hole) in an appropriate manner. The invention also relates to a liquid container with a corresponding opening (36) for and with this tap.

16 Claims, 6 Drawing Sheets

U.S. PATENT DOCUMENTS

| | | | | |
|---|---|---|---|---|
| 6,401,989 | B1 | 6/2002 | Grittmann | |
| 7,584,873 | B2 * | 9/2009 | Grittmann | 222/399 |
| 2008/0203118 | A1 * | 8/2008 | Sauer et al. | 222/396 |
| 2009/0302069 | A1 * | 12/2009 | Oberhofer et al. | 222/399 |

FOREIGN PATENT DOCUMENTS

| | | | |
|---|---|---|---|
| DE | 198 25 929 | A1 | 6/1999 |
| DE | 202 12 710 | U1 | 1/2003 |
| GB | 342067 | A | 1/1931 |

* cited by examiner

DISPOSABLE TAP FOR A PRESSURIZED LIQUID CONTAINER

BACKGROUND OF THE INVENTION

The present invention relates to a disposable tap for drawing liquids from a pressurized liquid container, which tap, relative to prior art taps, is modified such that it is attachable preferably in the upper area of the sidewall of the liquid container. The invention further relates to a liquid container unit having an appropriate opening for and provided with said tap.

It has been known for some time to provide in particular small size liquid containers such as beer kegs having a volume of 3 liters, 5 liters, or greater with a disposable tap that can be disposed off together with the container after drawing the liquid contained in the container. Such a tap is mounted in an opening of the sidewall of the liquid container that is located relatively far down the sidewall in order to be able to draw as much liquid as possible. In DE 198 25 929 A1 such a tap comprised of an outer tube inserted seal-tightly into the container as well as an inner tube slidable seal-tightly therein is disclosed. The outer tube has an intake opening that is positioned relatively close to the container wall and can be brought into a congruent position with the intake opening of the inner tube when the latter is pulled outwardly by means of a grip. The inner tube has moreover a discharge opening so that, when the two intake openings are congruent, liquid can flow into the tap and can be drawn from the discharge opening. For closing this tap, the inner tube must be completely pushed into the outer tube again. A disadvantage of this configuration is that, for shutting, the inner tube must be pushed after tapping into the outer tube again and again. When the tube is displaced during pushing, this can lead to unwanted escape of liquid.

On the other hand, the tap disclosed in DE 198 35 569 A1 is very safe and also easy to use. This tap also comprises an outer tube and an inner tube that is slidably arranged within the outer tube. In contrast to the taps that have been known before, the liquid discharge opening is provided in an outer area of the wall of the inner tube that must be pulled out of the outer tube far enough at the beginning of the first tapping operation. A valve that is arranged in the interior of the tube, whose valve cone is forced by the pressure inside the container as well as by the pulling action of an elastic actuating device against its seat, prevents in its closed rest position the liquid from passing and thus prevent the liquid from escaping from the discharge opening. The actuating device for this valve is comprised of an elastic button with a grommet that engages the bead of an extension of a valve plunger that, in turn, ends in the cone of the valve. By pressing down the button, the valve opens and liquid flows through the inner tube to the discharge opening. When the button is released, the valve will close automatically by the restoring force that is caused by the grommet that elastically engages the bead and is assisted by the inner pressure of the container.

According to this proposal, the liquid passes into the tap through openings in the end face of the inner tube. In order to protect the tap from liquid penetrating into it before being first put into operation, this opening is closed off by means of a protective sleeve that is pushed in a seal-tight way across the inner part of the outer tube and is provided at its an end face with a tubular extension having a smaller diameter. The inner tube is provided at its end face with a pin that is sized such that, in the initial state in which the inner tube is inserted completely into the outer tube, it projects into the tubular extension of the protective sleeve and closes it off in a seal-tight way.

Moreover, in the area of the outer tube that is positioned near the container wall a bore is provided for emptying residual liquid, which bore when pulling out farther the inner tube having a corresponding bore, can be brought into a congruent position with the inner tube so that residual liquid can flow into the tap when tilting the container.

A disadvantage of the above described systems is that the tap must be arranged far down the sidewall of the liquid container in order for the container to be emptied to a sufficient degree. Because of the limited space below the tap for drawing liquid, the container must be placed onto a stand or the edge of a table in order to draw liquid into an appropriate vessel, for example, a beer glass. The container therefore can be easily tipped over or it requires a support device specifically designed for it. Moreover, drawing liquid is cumbersome because of the low position of the tap.

It would therefore be desirable to provide a tap that can be arranged at the upper area of a liquid container in order to overcome the aforementioned disadvantages. This tap should also be protected against penetration of liquid before it is put to operation for the first time.

In order to be able to draw liquid from an above-described container or a container unit when the liquid level therein is below the tap, it is necessary to provide or to connect the container a system with which it is ensured that there is always overpressure within the container unit. Such systems are disclosed, for example, in DE 298 22 430.5 or U.S. Pat. Nos. 5,333,763; 4,923,095; or 5,769,282. All of the aforementioned systems are provided with a tap arrangement that is located at the upper end face of the liquid container unit. However, the latter is relatively bulky and large because the tap must project laterally past the edge of the upper end face so that drawing liquid is possible into a vessel arranged underneath. Therefore, there is only the choice of either delivering it separately for assembly at a later point in time or of abandoning the possibility of stacking the container units for the purpose of storage or transport because stacking would not be possible at all or possible only by taking up additional space and static conditions that are not optimal.

There is therefore the need for a system that avoids the afore described disadvantages.

Such a system could be operated by using an inner pressure reservoir or in inner pressure gas cartridge. Such pressure sources are known in principle. For example, DE 298 22 430 discloses a beverage container, for example, a small beer keg, in which a high-pressure bottle is positioned. Of course, it would also be possible to provide a high-pressure source centrally, at the bottom or on the lid of the small keg. The tap proposed for such a system and optionally additional means should therefore not project too far into the center of the container unit in order to allow a variety as large as possible of attachment possibilities for the pressure source.

It is an object of the present invention to provide a tap having the aforementioned desirable characteristic specifications.

SUMMARY OF THE INVENTION

This object is solved by the present invention in that the container/a container unit for receiving a liquid to be drawn therefrom is equipped with a bottom side, a sidewall and a lid or end face as well as an opening for attaching a tap, and said opening is located in the sidewall of the container/container unit, namely in an area that is closer to the lid or end face than to the bottom side of the sidewall. When the container unit is a conventional small beverage keg, for example, a small beer keg of aluminum, steel, another metal or plastic material, the opening is preferably arranged in the area above the circumferential projection that simulates the barrel hoop of former wooden kegs or, in the absence of such a projection, at a level that corresponds to the thus defined level in relation to the dimensions.

In accordance with the present invention a tap that can be mounted in the aforementioned opening of the liquid container unit without requiring noticeable space is provided that, at sufficient pressure within the container unit, allows liquid to be drawn even when the liquid level is located below that of the tap itself.

The invention is directed to a tap as disclosed and a combination of tap and riser duct as well as a container provided with the tap.

The tap according to the invention can be made in principle of any material; preferably, it is comprised however of plastic material and in a particular preferred embodiment of a combination of harder and more elastic plastic parts. It is manufactured as a complete unit and subsequently inserted seal-tightly into the opening provided for this purpose on the still empty liquid container, for example, a 5 liter mini keg for beer.

In order for the tap to be seal tightly and safely positioned horizontally, it preferably has on its outer sleeve a locking mechanism that can be configured as disclosed in the prior art. For example, the outer sleeve can have two circumferential flanges or annular locking wedge arrangements between which a sealing ring is arranged. When locking the outer sleeve in the opening of the container unit provided for this purpose, the edges of this opening will come to rest against the seal and are safely held by the flanges or the annular locking wedge arrangements.

The tube that is arranged in the inner channel of the outer sleeve in a seal-tight way is a sliding tube and has a grip on its end that is facing outwardly; in the mounted state, the grip is located outside of the liquid container unit. Moreover, near its axial outer end it has a discharge opening for the liquid to be drawn. The grip is designed such that, by pulling and optionally also by rotating, the sliding tube can be pulled comfortably from a position in which the discharge opening projects from the outer sleeve and a closed position in which the sliding tube is pushed into the sleeve to such an extent that the discharge opening is completely covered. This action is required for the tap according to the invention generally only once because preferably a valve device is provided that, without being actuated, prevents the free access of liquid to the discharge opening.

The closed position, in which the sliding tube has been pushed into the sleeve to such an extent that the sleeve completely covers the discharge opening, is generally identical to the position of complete insertion of the sliding tube into the outer sleeve. In order to prevent that the sliding tube cannot be pulled farther out past a desired adjustment in which the discharge opening projects from the outer sleeve, it is possible to realize in any desired way a locking means, for example, by providing a guide bore or opening in the outer sleeve that can interact with a slide block or the like arranged externally in the lower area of the slide tube. Such a configuration is disclosed, for example, in DE 198 35 569 A1 in which a slide block is used that is however tubular. Alternatively, for example, a groove-shaped recess can be provided that serves as a guide for a corresponding locking nose.

The already mentioned valve device, if provided, can also be realized in a suitable way as proposed in DE 198 35 569 A1. In this connection, the valve itself is located within the sliding tube at any position that is moved farther inwardly relative to the discharge opening. Preferably, it is arranged in the central area of the inner wall of the sliding tube and comprises, as disclosed e.g. in DE 198 35 569 A1, a valve seat that is formed as an annular collar on the inner side of the sliding tube and has a conical seat that can be sealed by means of a conical valve cone. The latter is connected to a valve plunger or formed as a monolithic part thereof wherein the valve plunger itself is provided at its outer end with annular beads or grooves that interact with corresponding structures of a grommet. The grommet is elastic and can be integrally formed with a bellows that can be pushed in from the exterior and is made from an elastic material such as rubber. When the rubber bellows is pressed down, the valve cone is moved away from the valve seat against the pressure of the liquid at the valve and against the restoring force originating from engagement of the elastic sleeve at the annual structures at the upper end of the valve plunger. Accordingly, liquid from the inner area of the sliding tube can reach the outer area and can be drawn from the discharge opening. When the rubber bellows is released, the valve returns into its closed initial position.

The sliding tube has at its inner end face openings or penetrations through which the liquid to be drawn can reach the interior of the tube. This should be possible however only once the liquid container unit is put in operation and tapping is to be started. It is therefore necessary to prevent the liquid from penetrating into the sliding tube before the first tapping action is carried out. This is realized in that the intake openings into the sliding tube that are provided at its end face are covered by a protective cover that at the same time optionally covers seal-tightly also the guide opening or an opening that is present for another reasons within the outer sleeve or within the inner sliding tube, or is realized in that the outer sleeve is laterally completely closed and is designed at its end face such that it effects in the same way a covering action of the intake openings at the end face of the sliding tube.

In the configurations with protective cover, the protective cover has a first tubular part that is pushed onto an inwardly positioned end portion of the outer sleeve, viewed in the axial direction, to such an extent that the aforementioned optionally present opening(s) or bore(s) in the lateral area of the outer sleeve are covered in a seal-tight way (the outer sleeve in this configurations is of a continuous tubular configuration and is open at its inner end). Moreover, the protective cover has, adjoining inwardly in the axial direction, a part with a tubular recess that can interact with a pin that is provided on the inner end face of the sliding tube and projects in the axial direction past the tube wall in such a way that in the completely inserted state of the sliding tube said pin seal-tightly closes off the aforementioned tubular recess. In regard to concrete configurations of this part of the inventive tap, reference is also being had to DE 198 35 569 A1.

Alternatively, the outer sleeve is formed such that it can take on the function of the protective sleeve. It should then have no lateral openings. Moreover, as mentioned above in connection with the protective sleeve, it also has, adjoining inwardly in the axial direction, a part with a tubular recess that can interact with a pin that is provided on the inner end face of the sliding tube and projects in the axial direction past the tube wall of the sliding tube in such a way that, in the completely inserted state of the sliding tube, said pin seal-tightly closes off the aforementioned tubular recess.

When the sliding tube is pushed by means of its grip into the position in which the discharge opening projects at the outer side of the liquid container unit from the outer sleeve, the pin moves also simultaneously out of the tubular recess of the protective cover or of the outer sleeve, and liquid can penetrate into the sliding tube, namely to the level of the sealing valve, if provided. The tapping action is then realized exclusively by actuation of this valve without the sliding tube having to be moved relative to the outer sleeve.

According to the present invention, the protective cover or the outer sleeve is closed in the axial direction of the tap at its end face, but has laterally an opening that is provided with a means for seal-tightly connecting thereto a pipe or hose serving as a riser duct and, in the outwardly pushed state of the tube, is in fluid communication with the interior of the sliding tube. This opening can be designed in different ways.

In a first preferred configuration of the invention, according to a first alternative a protective cover is provided that follows the contour of the outer sleeve and an outer annular area of the end face on the end face of the outer sleeve and then passes into a tube whose inner diameter forms the aforementioned tubular recess. In this tube with reduced diameter a lateral opening or cutout is provided that is surrounded by an annular bead or flange in such a way that a pipe or a hose can be coupled thereto that should extend to the bottom of the liquid container unit and serve as a riser duct. This pipe or this hose can be pulled either externally across the annular bead or flange or can be inserted therein. It is convenient to select the materials of both components or their diameter such that they are secured to one another by friction in a seal-tight way.

This configuration can be realized in a second alternative without protective cover when the outer sleeve is realized in the way described above. In this case, a lateral opening or cutout surrounded by an annular bead or flange is located in the above described part of the outer sleeve that inwardly adjoins in axial direction and is provided with the aforementioned tubular recess. For coupling a pipe or hose to the riser duct, the disclosure provided in the above paragraph applies as well.

In a second preferred embodiment of the invention, the tubular recess of the protective cover or of the correspondingly shaped outer sleeve opens in the axial direction in a passage that extends in a curve or elbow shape to a laterally provided opening in the protective cover or in the outer sleeve. In this configuration, both variants, i.e., the protective cover as well as the outer sleeve, can be formed as a one-part or optionally also as a two-part configuration, wherein in the latter case one of the parts of the protective cover comprises the first tubular part as well as the tubular recess and the second part that surrounds the curved passage can be configured as an adapter with a cutout which cutout can be pushed onto the outer wall of the aforementioned tubular recess or can be attached in other ways thereto.

In all of these cases, the outer sleeve is either laterally completely closed or it has exclusively the aforementioned guide opening or a similar opening provided in connection with the locking device of the sliding tube in the extended state which opening is then covered by the protective cover. An opening for emptying residual liquid is not required.

In an especially preferred embodiment of the invention, the retractable tap is comprised of seven or eight parts, i.e., an elastic cap that is configured as a monolithic part of the aforementioned grommet; a valve plunger with an extension that interacts in the described way with the grommet; a valve cone that is pushed onto the valve plunger and can be locked therein; a sliding tube with grip and optionally a bore for the locking mechanism, for example, the aforementioned guide bore; the outer sleeve; an insert that is insertable into the inner tubular opening of the sliding tube; and the pin; intake openings for the liquid at the end face; and optionally components for the locking mechanism such as a slide block; as well as a one-part or two-part protective cover.

From the above explanations it is apparent that a tap with the features according to the invention will fulfill the posed requirements. It is protected with regard to escape of liquid before first being put in operation. It has means for a seal-tight coupling of a pipe or hose through which, when overpressure is present in the container unit, liquid is forced into the tap even when the liquid level is below the tap. It requires no opening for emptying residual liquid. And based on the fact that the coupling means for the pipe or the hose is arranged laterally and can thus point downwardly in the mounted state, the tap can be used in combination with any suitable system for pressure loading, even when the systems e.g. extend centrally from to the cover or the inner topside of the container unit farther downwardly than the level where the tap is arranged.

The tap according to the invention is usable in combination with any container shape and container size. It is expedient for larger container units, for example, having a contents of 3 liters, 5 liters or more. In the past few years, cans of this size have also been in use. Thus, the tap can be used, for example, in combination with so-called mini kegs that can be of a two-part configuration (container body comprised of bottom wall and sidewall with lid) or of a three-part configuration (bottom, sidewall, and lid) wherein the lid and optionally also the bottom is/are connected by conventional double fold closure or are crimped in other ways to the container bottom or the sidewall. The shape of such a mini keg can be designed to imitate that of old kegs; often, they have a radial-symmetrical or approximately radial-symmetrical shape (for example, with a polygonal shape imitating the wooden structure of old kegs). Decorative projections reminiscent of the barrel hoops of old kegs can be provided circumferentially at the appropriate locations of the sidewall. The container unit can rest on their bottom or on a rim structure that is formed on the bottom area. The tap according to the invention can be arranged at the upper area of the sidewall so that the container unit or the mini keg when manufactured is provided with an opening in the sidewall at the location provided for this purpose.

In the following, the invention will be explained in an exemplary way with the aid of the drawings.

DESCRIPTION OF PREFERRED EMBODIMENTS

Figure 1:
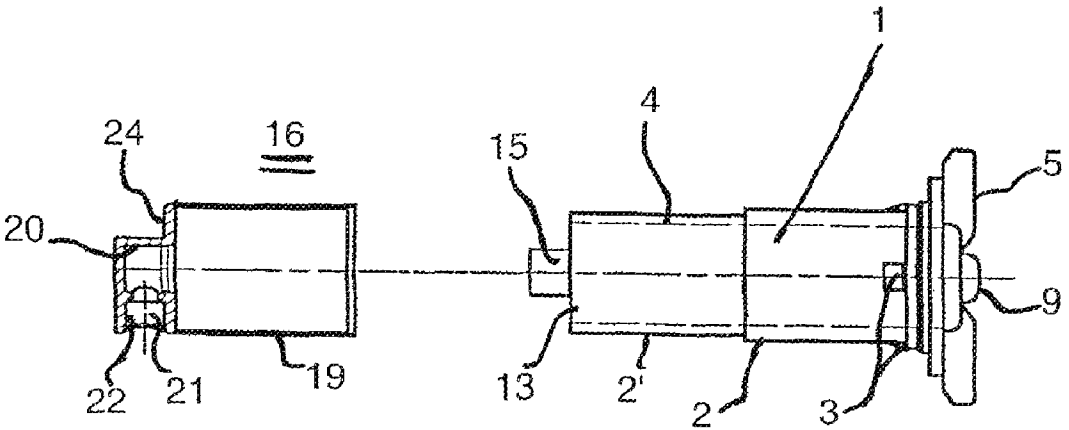
FIG. 1 shows a first embodiment of the invention wherein the tap has a one-part protective cover shown removed from the outer sleeve.

In FIG. 1, a first embodiment of the tap according to the present invention, i.e., a tap 1 with a one-part protective cover 16 illustrated in the removed state in this Figure, is shown. The tap comprises an outer sleeve 2 with locking noses 3 and a sliding tube 4 that is slidably arranged in the sleeve 2. The locking noses serve for attachment to the liquid container. On the inwardly facing end face 13 of the sliding tube 4 that has intake openings, not shown in the Figure, a pin 15 is mounted.

Said tube ends with a grip 5 on the exterior side that is located in the mounted state of the tap on the exterior of the liquid container unit.

The protective cover 16 is pushed with its tubular part 19 onto the end portion 2' of the outer sleeve that, viewed in the axial direction, is provided inwardly (for this purpose, it has a somewhat smaller outer diameter in comparison to the remaining part) until the end face 13 of the sliding tube 4 contacts the wall 24. In this connection, the tubular recess 20 of the protective cover engages seal-tightly the pin 15. The tap is delivered and mounted in this position.

Figure 7:
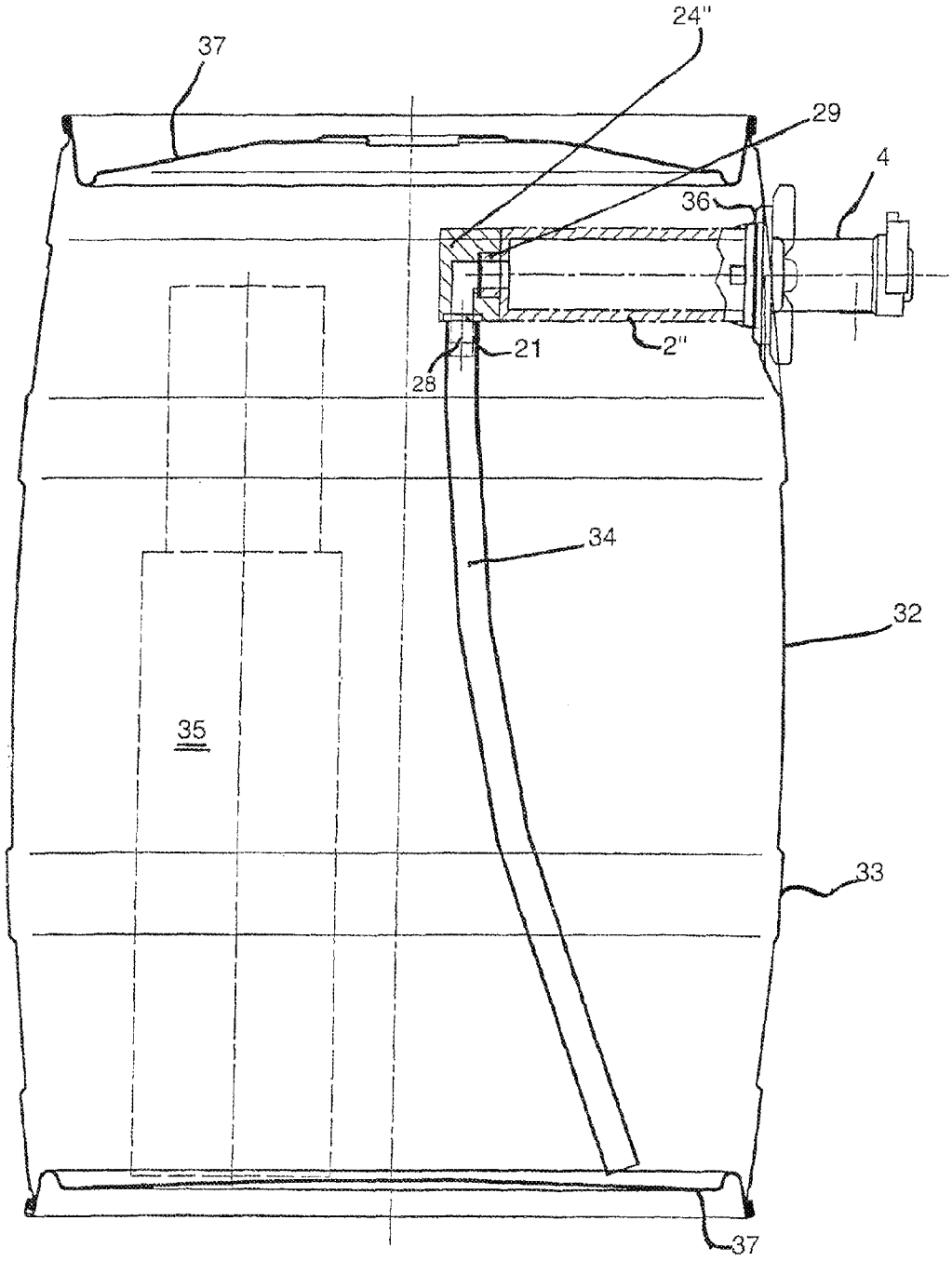
FIG. 7 shows an arrangement of a tap according to the invention on a container.

On the protective cover, a lateral opening 21 is shown that in the mounted state faces downwardly; a hose or a hose coupling can be inserted into its sidewall 22. This hose serves as a riser duct, as shown in FIG. 7.

Figure 4:
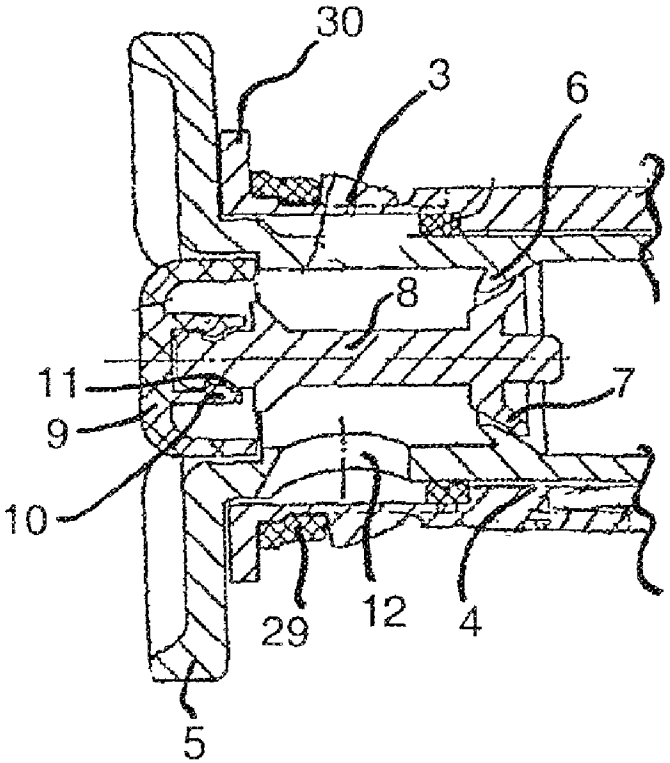
FIG. 4 shows a valve mounted in the grip of the tube inserted in the outer sleeve.

When the tap is to be put in operation, first the sliding tube is pulled outwardly by means of the grip 5. When doing so, the pin 15 is pulled out of the recess 20. In this way, a liquid communication between the lateral opening 21 of the protective cover and the intake openings in the end face 13 is provided so that liquid can flow from the end of the riser duct into the interior of the tap. For drawing liquid, it is sufficient when a valve that is arranged in the interior of the sliding tube and illustrated in an exemplary fashion in FIG. 4 is opened; this is done by pressing down the rubber bellows 9. Restoring forces, as explained in the above description, close the valve again when the rubber bellows is released. The sliding tube 4 can therefore remain in its extracted position.

Figure 2:
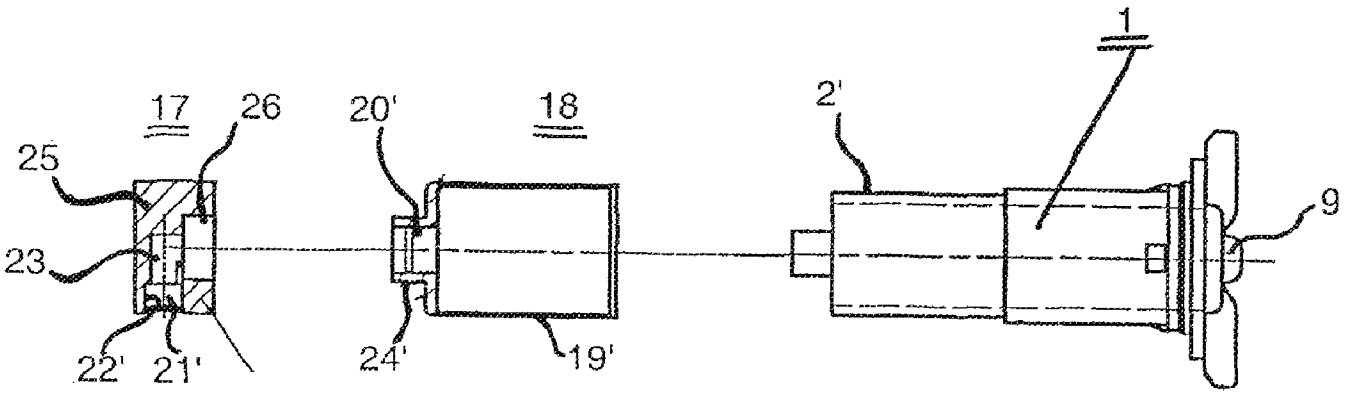
FIG. 2 shows a second embodiment of the invention wherein the tap has a two-part protective cover shown removed from the outer sleeve.

FIG. 2 shows an embodiment that differs from that illustrated in FIG. 1 in that the protective cover is of a two-part configuration. The tap 1 corresponds to that of FIG. 1. The protective cover is comprised of a first part 18 that has two tubular sections 19', 20'. The first of these parts has such a diameter that it can be seal-tightly pushed onto the outer sleeve of the tap while the second one surrounds seal-tightly the pin 15. An adapter 17 can be pushed onto its outer wall 24'. When the assembled tap is put in operation, the pin 15 is pulled out of the recess 20' and, by means of the elbow duct 23 formed in the adapter part 25, a fluid connection is realized between the downwardly facing opening 21' of the adapter and the intake openings in the end face 13. In the sidewall 22' of the opening 21', a hose or hose adapter or the like is inserted in order to provide a riser duct.

Figure 3:
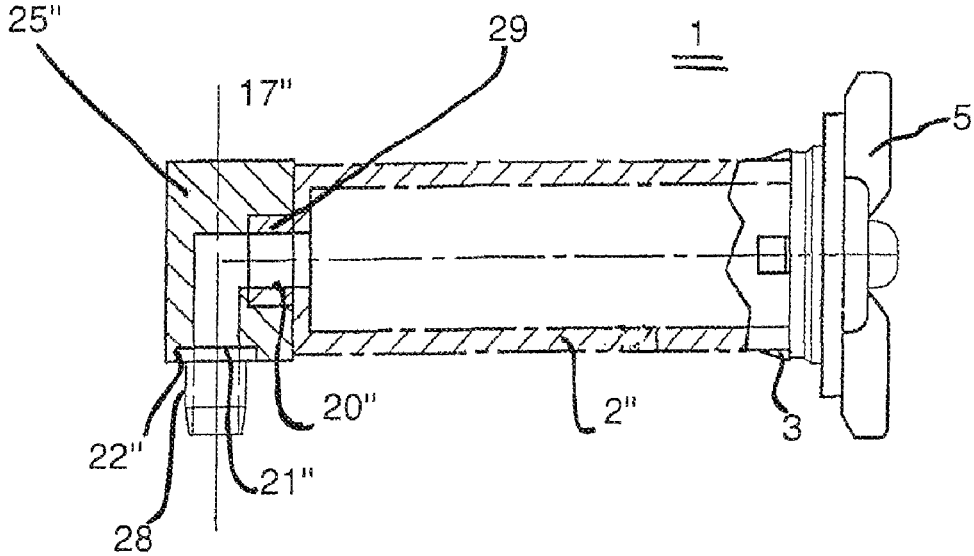
FIG. 3 shows a third embodiment of the invention wherein the tap has an adapter part connected to an outer sleeve without protective cover.

FIG. 3 shows a configuration of the tap with an outer sleeve of a two-part configuration instead of a separate protective cover. At the end of the first part 2" it has an extension 29 in which the tubular recess 20" is positioned for seal-tightly surrounding the pin 15 (not illustrated here). Onto this extension 29 an adapter 17" is pushed that corresponds to the adapter 17 illustrated in FIG. 2. An intermediate member 28 is inserted into its opening 21" by means of which the riser duct or riser hose can be connected to the adapter.

FIG. 4 shows a specific configuration of a valve arrangement that is useable in the tap according to the invention and known from DE 19835560 A1. In the wall of the sliding tube 4 an annular bulge 6 is provided that cooperates with a conical valve cone 7. The latter can be actuated by means of a valve plunger 8 that has at its upper end an annular recess 11 that is engaged by an annular projection 10 of a rubber grommet that is integrally formed on a rubber bellows 9. This Figure shows also the locking noses 3 as well as a collar 30 that serves as locking means for locking the tap in the container opening. A sealing means 29 is provided for sealing that is comprised, for example, of a yielding plastic material ring.

Figure 5:
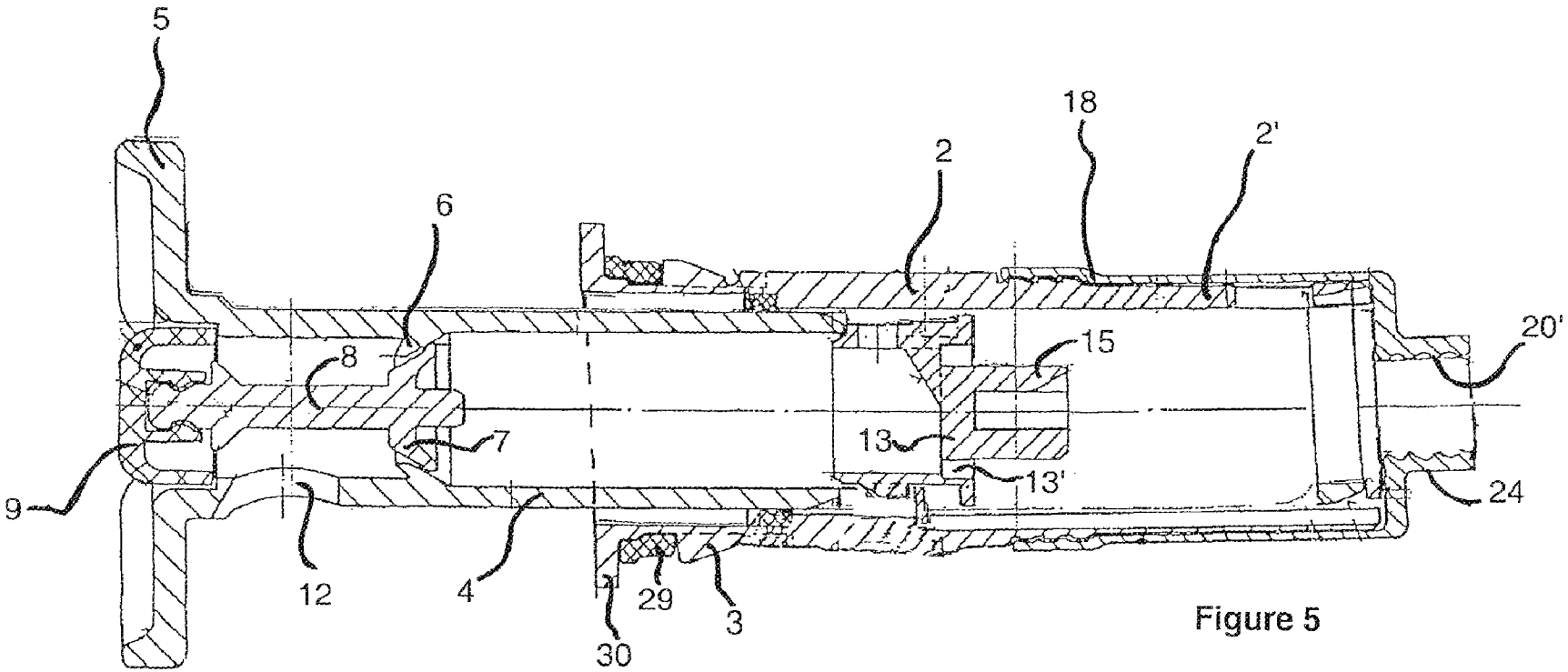
FIG. 5 shows the tube pulled out of the outer sleeve.

In FIG. 5 the tap 1 according to FIG. 2 with the pushed-on first part of the protective cover 18 but without adapter is shown in a position in which the sliding tube 4 with its discharge opening 12 has been pulled out so that the liquid can flow in through intake openings 13' provided in the end face 13. The reference numerals correspond to those of FIGS. 1, 2, and 4.

Figure 6:
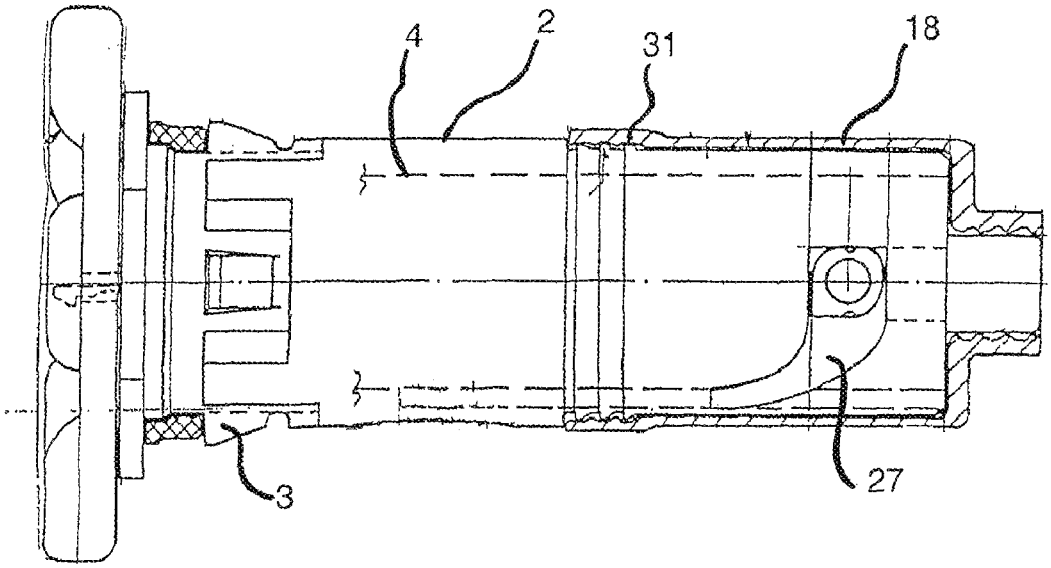
FIG. 6 illustrates locking grooves of the protective sleeve and a locking action between tube and outer sleeve.

In FIG. 6, one embodiment of the tap with two-part protective cover is provided wherein however, as in FIG. 5, only the part 18 of the protective cover is shown that has small locking grooves 31 arranged thereon in the direction toward the axial outer side in this Figure. At 27 locking of the sliding tube 4 on the outer sleeve 2 by means of a guide bore in interaction with a slide block is shown, as disclosed in the description.

FIG. 7 shows a tap as illustrated in FIG. 3, mounted in a liquid container unit that is in the form of a mini keg with circumferential bulges 33 that imitate the former conventional barrel hoops. The mini keg has a bottom part 37, a sidewall 32, and a lid part 38. The tap is seal-tightly mounted in the lateral opening 36. The adapter 17" described in FIG. 3 has been pushed onto the extension 29 of the sleeve 2"; it is illustrated that the sliding tube 4 is pulled partially out of the sleeve 2". By means of intermediate member 28 a hose 34 serving as a riser duct is attached to the opening 21". The presence of a pressure reservoir 35 is indicated in dashed lines.

What is claimed is:

1. A retractable tap for drawing pressurized liquid from a liquid container unit and for insertion into a container opening provided in a sidewall of the liquid container unit closer to a topside of said container unit than to a bottom part, the retractable tap comprising an outer sleeve comprising an outer end, an inner end, and a locking mechanism arranged in the vicinity of the outer end for effecting a seal-tight attachment in the container opening, wherein an axial direction of the outer sleeve, in a mounted state in the container opening, extends horizontally or substantially horizontally;

a tube arranged seal-tightly and slidably in an inner passage of the outer sleeve;

wherein the tube comprises a tube wall and a grip connected to the tube wall, wherein the grip is positioned externally to the container unit when the outer sleeve is in the mounted state and wherein the tube wall has a discharge opening for liquid adjacent to the grip;

wherein the tube has an inwardly positioned end face that is remote from the grip and is provided with intake openings and with a pin projecting from the end face;

means provided on the outer sleeve and on the tube that limit a sliding action of the tube between a first position that is an open tube position in which the discharge opening projects from the outer sleeve and a second position that is a closed tube position in which the tube is inserted into the outer sleeve to such an extent that the outer sleeve completely covers the discharge opening;

a valve device closing off the discharge opening of the tube seal-tightly against penetration of liquid in a closed position of the valve device;

an actuating device acting on the valve device and arranged at the grip, wherein the actuating device opens the valve device against a force that forces the valve device into the closed position;

a protective cover comprising a first portion and a second portion, wherein the first portion is tubular and is pushed onto the inner end of the outer sleeve to such an extent that the first portion seal-tightly covers the outer sleeve, wherein the second portion adjoins the first portion in the axial direction of the outer sleeve and has a tubular recess seal-tightly surrounding the pin in the second position of the tube in which second position the tube is completely inserted into the outer sleeve and wherein the pin is moved out of the tubular recess in the first position of the tube;

wherein the outer sleeve has a circumferential wall having no opening in areas of the circumferential wall that are not covered by the protective cover so that no fluid communication through the circumferential wall is possible between the container interior and an interior of the outer sleeve in the open tube position and in the closed tube position of the tube;

wherein the protective cover has a closed-off end face remote from the first portion and has a lateral opening provided with coupling means for seal-tightly coupling a pipe or a hose thereto;

wherein the lateral opening, in a second state of the tube in which second state the tube is pushed out of the outer sleeve, is in fluid connection with an interior of the tube.

2. The tap according to claim 1, wherein the lateral opening is connected to the tubular recess and wherein the coupling means is a sidewall surrounding the lateral opening, into which sidewall a pipe or hose can be inserted seal-tightly or which sidewall is seal-tightly surrounded by a pipe or a hose.

3. The tap according to claim 1, wherein the protective cover comprises an adapter part that adjoins in the axial direction the tubular recess and wherein the adapter part has a recess that opens laterally into the lateral opening.

4. The tap according to claim 3, wherein the recess of the adapter part is an elbow duct.

5. The tap according to claim 1, wherein the protective cover is of a one-part configuration.

6. The tap according to claim 1, wherein the protective cover is comprised of first and second separate parts, wherein the first separate part comprises the first portion and the tubular recess and wherein the second separate part is an adapter with a recess pushed onto an outer wall of the tubular recess.

7. The tap according to claim 1, further comprising a riser duct for drawing liquid from a container unit in which the liquid to be drawn is pressurized, wherein the riser duct is a hose that is coupled to the coupling means.

8. A container unit for receiving a liquid to be drawn therefrom, comprising a liquid container with a bottom part, a sidewall of substantially radial symmetry, and a lid part, wherein the sidewall has only one opening that is suitable for receiving a tap and is positioned closer to the lid part than to the bottom part, the container unit comprising a tap according to claim 1, wherein the tap is arranged in the opening.

9. A retractable tap for drawing pressurized liquid from a liquid container unit and for insertion into a container opening provided in a sidewall of the liquid container unit closer to a topside of said container unit than to a bottom part, the retractable tap comprising an outer sleeve comprising an outer end, an inner end, and a locking mechanism arranged in the vicinity of the outer end for effecting a seal-tight attachment in the container opening, wherein an axial direction of the outer sleeve, in a mounted state in the container opening, extends horizontally or substantially horizontally;

a tube arranged seal-tightly and slidably in an inner passage of the outer sleeve;

wherein the tube comprises a tube wall and a grip connected to the tube wall, wherein the grip is positioned externally to the container unit when the outer sleeve is in the mounted state and wherein the tube wall has a discharge opening for liquid adjacent to the grip;

wherein the tube has an inwardly positioned end face that is remote from the grip and is provided with intake openings and with a pin projecting from the end face;

means provided on the outer sleeve and on the tube that limit a sliding action of the tube between a first position that is an open tube position in which the discharge opening projects from the outer sleeve and a second position that is a closed tube position in which the tube is inserted into the outer sleeve to such an extent that the outer sleeve completely covers the discharge opening;

a valve device closing off the discharge opening of the tube seal-tightly against penetration of liquid in a closed position and an actuating device acting on the valve device and arranged at the grip, wherein the actuating device opens the valve device against a force that forces the valve device into the closed position;

wherein the outer sleeve has a circumferential wall that is circumferentially closed so that no fluid communication through the circumferential wall is possible between the container interior and an interior of the outer sleeve in the open tube position and in the closed tube position;

wherein the outer sleeve has an extension part, which extension part adjoins the inner end and has a tubular recess seal-tightly surrounding the pin in the second position of the tube in which second position the tube is completely inserted into the outer sleeve and wherein the pin is moved out of the tubular recess in the first position of the tube;

wherein the extension part has a closed-off end face remote from the inner end and has a lateral opening provided with coupling means for seal-tightly coupling a pipe or a hose thereto;

wherein the lateral opening, in a second state of the tube in which second state the tube is pushed out of the outer sleeve, is in fluid connection with an interior of the tube.

10. The tap according to claim 9, wherein the coupling means is a sidewall surrounding the lateral opening, into which sidewall a pipe or hose can be inserted seal-tightly or which sidewall is seal-tightly surrounded by a pipe or a hose.

11. The tap according to claim 9, wherein the extension part comprises an adapter part and wherein the lateral opening is located in the adapter part and the adapter part has a recess connected to the lateral opening and connected to the tubular recess.

12. The tap according to claim 11, wherein the recess of the adapter part is an elbow duct.

13. The tap according to claim 9, wherein the outer sleeve is of a one-part configuration.

14. The tap according to claim 9, wherein the outer sleeve is comprised of first and second separate parts, wherein the first separate part comprises the tubular recess and wherein the second separate part is an adapter with a recess pushed onto an outer wall of the tubular recess.

15. The tap according to claim 9, further comprising a riser duct for drawing liquid from a container unit in which the liquid to be drawn is pressurized, wherein the riser duct is a hose that is coupled to the coupling means.

16. A container unit for receiving a liquid to be drawn therefrom, comprising a liquid container with a bottom part, a sidewall of substantially radial symmetry, and a lid part, wherein the sidewall has only one opening that is suitable for receiving a tap and is positioned closer to the lid part than to the bottom part, the container unit comprising a tap according to claim 9, wherein the tap is arranged in the opening.

* * * * *